US011674780B2

(12) United States Patent
Carlston

(10) Patent No.: US 11,674,780 B2
(45) **Date of Patent: *Jun. 13, 2023**

(54) AIR DRIVEN PROJECTILE

(71) Applicant: Shooting Edge Technology, LLC, Lehi, UT (US)

(72) Inventor: Marvin Carlston, Lehi, UT (US)

(73) Assignee: Shooting Edge Technology, LLC, Lehi, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/176,120

(22) Filed: Feb. 15, 2021

(65) Prior Publication Data

US 2021/0404780 A1 Dec. 30, 2021

Related U.S. Application Data

(63) Continuation of application No. 16/419,325, filed on May 22, 2019, now Pat. No. 10,921,103, which is a continuation of application No. 15/094,629, filed on Apr. 8, 2016, now abandoned, which is a continuation-in-part of application No. 14/751,895, filed on Jun. 26, 2015, now abandoned.

(60) Provisional application No. 62/018,165, filed on Jun. 27, 2014.

(51) Int. Cl.
*F42B 6/10* (2006.01)

(52) U.S. Cl.
CPC ..... *F42B 6/10* (2013.01)

(58) Field of Classification Search
CPC ..... F42B 14/00; F42B 14/02; F42B 14/06; F42B 6/10; F41F 1/00
USPC ..... 102/520–527; 124/41.1
See application file for complete search history.

(56) References Cited

U.S. PATENT DOCUMENTS 1,861,522 A * 6/1932 Brandt ..... F42B 14/02 102/527
2,725,048 A * 11/1955 Koogle ..... F41B 11/62 124/71
2,861,560 A * 11/1958 Alinari ..... F41B 11/83 124/69
2,900,972 A * 8/1959 De Loss ..... F41B 11/83 124/63
3,090,151 A * 5/1963 Stewart ..... F41B 11/83 43/6
3,434,425 A * 3/1969 Critcher ..... F42B 10/08 102/399
3,476,048 A * 11/1969 Irwin ..... F42B 29/00 102/399
3,585,934 A * 6/1971 Mueller ..... F42B 30/14 102/371
3,613,596 A * 10/1971 Walde ..... C03B 18/06 102/525

(Continued)

FOREIGN PATENT DOCUMENTS

GB 2027855 A * 2/1980 ..... F42B 14/061

*Primary Examiner* — Jonathan C Weber
(74) *Attorney, Agent, or Firm* — Thorpe North & Western, LLP; Peter M. de Jonge; Kurt Hendricks

(57) ABSTRACT

A system for propelling an air-driven projectile from an air gun includes an air gun with an elongate bore and a source of compressed air in fluid communication with the elongate bore. A projectile is disposed within the bore of the air gun, the projectile having an outer diameter that is less than an inner diameter of the elongate bore.

9 Claims, 6 Drawing Sheets

(56) References Cited

U.S. PATENT DOCUMENTS 3,735,747 A * 5/1973 Barjavel ..... F41B 11/83 124/74
3,800,656 A * 4/1974 Schnabele ..... F41A 1/10 89/1.701
3,837,107 A * 9/1974 Swaim ..... F42B 5/045 42/105
3,868,114 A * 2/1975 Groner ..... F42B 6/08 473/582
4,123,975 A * 11/1978 Mohaupt ..... F42B 10/08 102/518
4,552,071 A * 11/1985 Horais ..... F42B 14/02 102/524
4,625,706 A * 12/1986 Turner, Jr. ..... F42B 6/00 124/22
4,854,067 A * 8/1989 Tersiev ..... F41B 11/83 43/6
5,086,749 A * 2/1992 Ekstrom ..... F41B 11/83 124/56
5,090,328 A * 2/1992 Theis ..... F42B 14/064 102/522
5,259,319 A * 11/1993 Dravecky ..... F42B 5/073 102/439
5,311,855 A * 5/1994 Basik ..... F42B 6/04 124/24.1
5,846,147 A * 12/1998 Basik ..... F42B 10/12 473/586
5,971,875 A * 10/1999 Hill ..... F42B 6/06 473/578
6,600,126 B2 * 7/2003 Steinhoff ..... F42B 12/76 102/526
6,695,727 B1 * 2/2004 Kuhn ..... F42B 6/06 473/586
7,037,222 B2 * 5/2006 Mizek ..... F42B 6/08 473/583
7,322,297 B2 * 1/2008 Yaich ..... B23B 27/06 102/517
7,398,721 B1 * 7/2008 Alberding ..... F41B 11/00 89/1.806
7,955,201 B2 * 6/2011 Harwath ..... F42B 6/04 473/578
8,057,330 B2 * 11/2011 Blosser ..... F42B 6/04 473/582
8,157,679 B2 * 4/2012 Cyr ..... F42B 12/68 473/578
9,366,510 B1 * 6/2016 Zobell ..... F42B 6/04
9,410,773 B2 * 8/2016 Greenwood ..... F42B 6/04
9,658,036 B2 * 5/2017 Zobell ..... F42B 6/08
9,739,581 B2 * 8/2017 Zobell ..... F42B 6/08
9,772,169 B2 * 9/2017 Greenwood ..... F42B 6/04
2002/0002926 A1 * 1/2002 Steinhoff ..... F42B 12/76 102/526
2005/0188979 A1 * 9/2005 Berry ..... F42B 14/064 124/76
2007/0144395 A1 * 6/2007 Yaich ..... F42B 33/005 102/439
2008/0257192 A1 * 10/2008 Schaeffer ..... F42B 5/035 102/438
2009/0075766 A1 * 3/2009 Ben ..... F42B 6/04 473/578
2010/0288256 A1 * 11/2010 Mattos ..... F41B 11/62 124/73
2014/0251296 A1 * 9/2014 Flint ..... F41B 11/723 124/57
2015/0024880 A1 * 1/2015 Pedersen ..... F41B 5/1484 473/575
2016/0010959 A1 * 1/2016 Greenwood ..... F42B 6/04 473/585
2016/0238356 A1 * 8/2016 Zobell ..... F42B 6/04
2016/0282093 A1 * 9/2016 Zobell ..... F42B 6/04

* cited by examiner

AIR DRIVEN PROJECTILE

PRIORITY CLAIMS

The present application is a continuation of U.S. patent application Ser. No. 16/419,325, filed May 22, 2019, which is a continuation of U.S. patent application Ser. No. 15/094,629, filed Apr. 8, 2016, which is a continuation-in-part of U.S. patent application Ser. No. 14/751,895 filed Jun. 26, 2015, which claims to the benefit of U.S. Provisional Patent Application No. 62/018,165 filed Jun. 27, 2014, the entire specifications of which are incorporated herein by reference in their entireties.

FIELD OF THE INVENTION

This invention relates generally to projectiles. Specifically, it relates to an improved projectile for use in an air gun or bow.

BRIEF DESCRIPTION OF THE FIGURES

To further clarify the above and other aspects of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The drawings are not drawn to scale. The invention will be described and explained with additional specificity and detail through the use of the accompanying drawings in which.

DETAILED DESCRIPTION OF THE ILLUSTRATED EMBODIMENT

Figure 1:
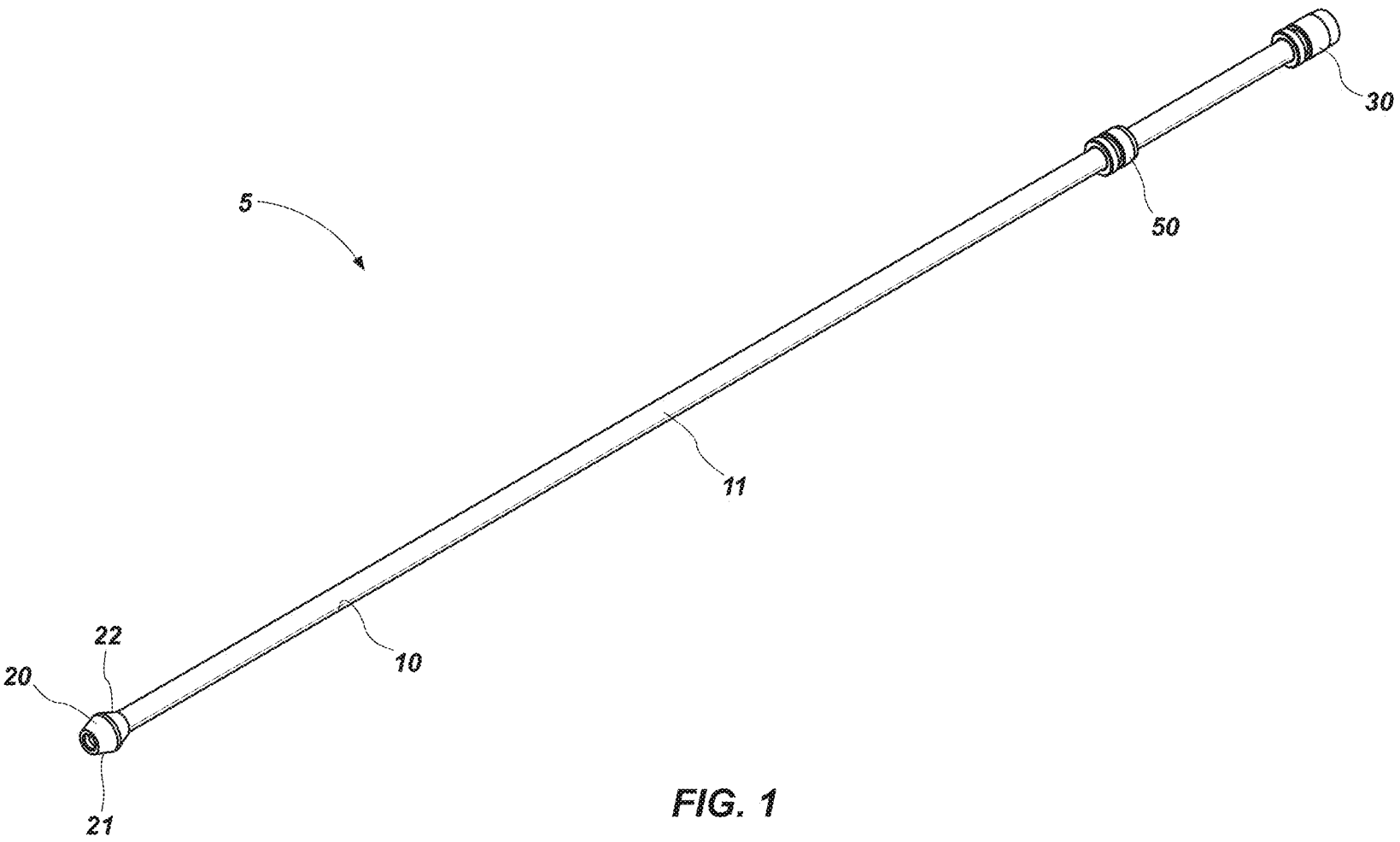
FIG. 1 is a perspective view of a projectile in accordance with one aspect of the technology.
Figure 2A:
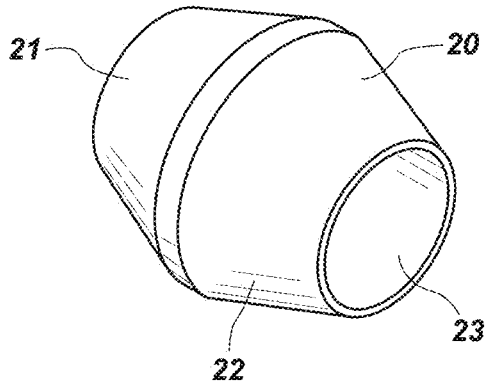
FIG. 2*a* is a perspective view of a stabilizer in accordance with one aspect of the technology.
Figure 2B:
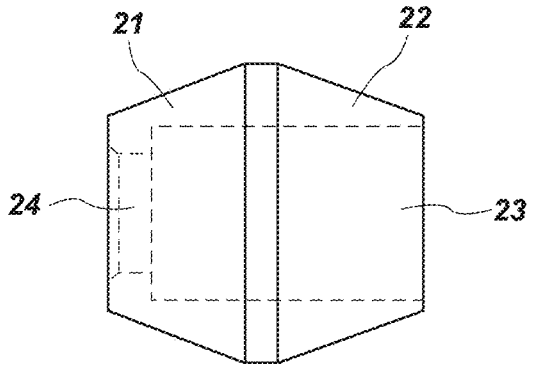
FIG. 2*b* is a cross-sectional side view of the stabilizer of FIG. 2*a;*
Figure 2C:
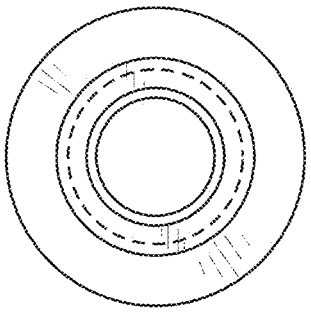
FIG. 2*c* is a top view of the stabilizer of FIG. 2*a;*
Figure 2D:
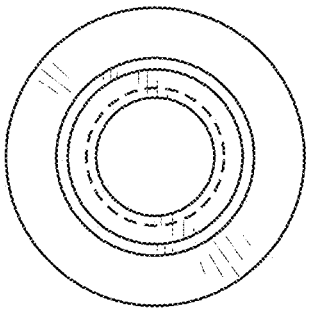
FIG. 2*d* is a bottom view of the stabilizer of FIG. 2*a;*
Figure 3A:
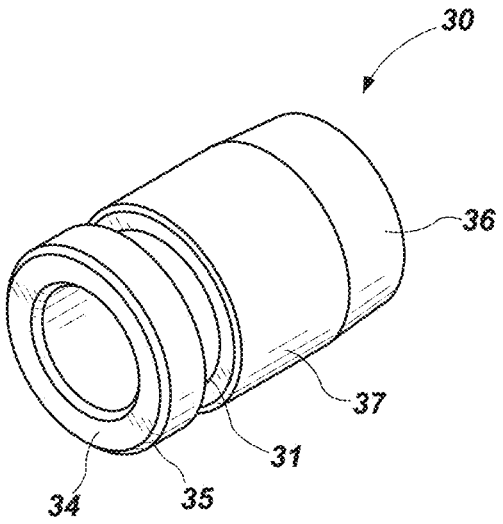
FIG. 3*a* is a perspective view of a butt in accordance with one aspect of the technology.
Figure 3B:
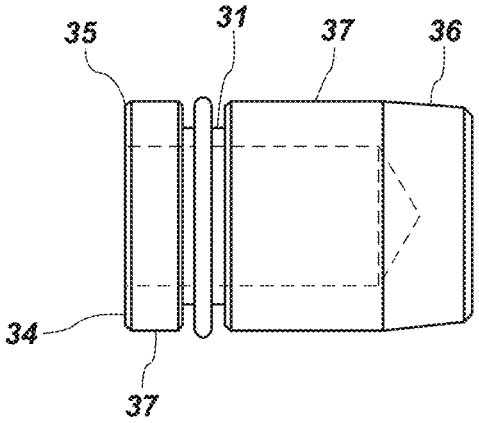
FIG. 3*b* is a cross-sectional side view of the butt shown in FIG. 3*a;*
Figure 3C:
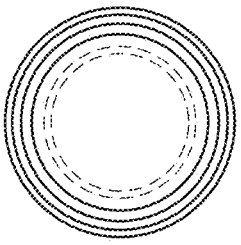
FIG. 3*c* is a top view of the butt shown in FIG. 3*a;*
Figure 4A:
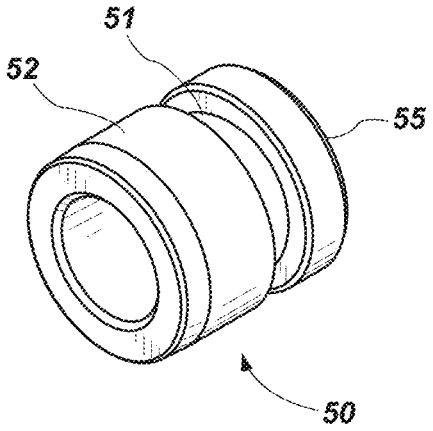
FIG. 4*a* is a perspective view of a tip in accordance with one aspect of the technology.
Figure 4B:
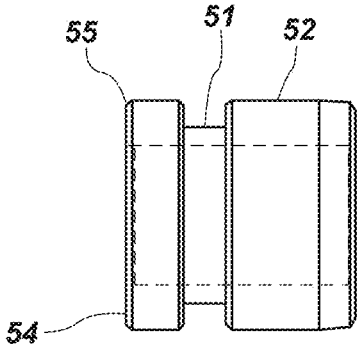
FIG. 4*b* is a cross-sectional side view of the tip shown in FIG. 4*a;*
Figure 4C:
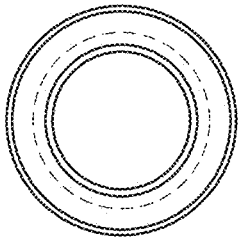
FIG. 4*c* is a top view of the tip shown in FIG. 4*a;*

The following detailed description of exemplary embodiments of the invention makes reference to the accompanying drawings, which form a part hereof and in which are shown, by way of illustration, exemplary embodiments in which the technology may be practiced. While these exemplary embodiments are described in sufficient detail to enable those skilled in the art to practice the invention, it should be understood that other embodiments may be realized and that various changes to the technology may be made without departing from the spirit and scope of the present invention. Thus, the following more detailed description of the embodiments of the present technology is not intended to limit the scope of the invention, as claimed, but is presented for purposes of illustration only and not limitation to describe the features and characteristics of the present technology, to set forth the best mode of operation of the technology, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

The present technology in its various embodiments, some of which are depicted in the figures herein, can be broadly described as an improved projectile having a tip disposed about the end of a shaft and butt elements disposed about the rear end of the shaft. In one aspect, a stabilizer member is disposed apart from the butt element. However, in another aspect, the butt also comprises a stabilizer member. Broadly speaking, the technology resides in a shaft with a tip sized to be slightly larger than the diameter of a rifle bore so as to stop further downward movement of the elongate projectile shaft within the bore. A cylindrical butt is disposed about the rear end of the elongate projectile shaft having a front face that induces a predetermined amount of drag about the butt. A cylindrical stabilizer can be disposed forward of the butt and also has a front face that induces an amount of drag about the stabilizer. Advantageously, the enhanced drag about the front face of the butt/stabilizer functions to "center" the elongate projectile while in flight, increasing the ability of the elongate projectile to travel straight to its intended target. While an elongate air projectile for use in an air gun is specifically referenced herein, one of ordinary skill in the art will recognize that the technology can be used in connection with an arrow used in a traditional bow, compound bow, or other device that is capable of providing a force to the rear end of the projectile. The resulting projectile is more accurate over longer distances than traditional elongate projectiles (i.e., arrows and elongate projectiles) and is safer and quieter than conventional firearms. In addition, aspects of the projectile may be used as a standalone slug to be fired from an air-gun. For example, in one aspect of the technology, the butt may be used by itself as a bullet or slug in an air gun.

The projectile disclosed herein may be used in connection with an air gun. An air gun is any variety of projectile weapon that propels projectiles by means of compressed air or other gas, in contrast to firearms which use a propellant charge. Air guns are used for hunting, pest control, recreational shooting (commonly known as plinking), and competitive sports, such as the Olympic 10 m Air Rifle and 10 m Air Pistol events. In one aspect of the technology, the elongate projectile is used in connection with an air gun having a rifled bore. Rifling is the process of making helical grooves in the barrel of a gun or firearm, which imparts a spin to a projectile around its longitudinal axis. This spin serves to gyroscopically stabilize the projectile, improving its aerodynamic stability and accuracy. Rifling is often described by its twist rate, which indicates the distance the rifling takes to complete one full revolution, such as a one inch turn in ten inches (1:10 inches), or a 1 millimeter turn in 254 mm (1:254 mm). A shorter distance indicates a "faster" twist, meaning that for a given velocity the projectile will be rotating at a higher spin rate. The combination of length, weight and shape of a projectile determines the twist rate needed to stabilize it—barrels intended for short, large-diameter projectiles like spherical lead balls require a very low twist rate, such as 1 turn in 48 inches (122 cm). Barrels intended for long, small-diameter bullets, such as the ultra-low-drag, 80-grain 0.223 inch bullets (5.2 g, 5.56 mm), use twist rates of 1 turn in 8 inches (20 cm) or faster.

In some cases, rifling will have twist rates that increase down the length of the barrel, called a gain twist or progressive twist. Long projectiles, such as the elongate projectiles described herein, are thought to require high twist rates and are recommended to be fired from a smoothbore barrel. Aspects of the technology described herein cure that deficiency.

Projectile shafts, including arrows, have various sizes and fletchings or vanes of different designs. These vanes are for the purpose of better stabilization to start the arrow or elongate projectile shaft spinning. Spinning the arrow shaft is important for shaft stabilization for a number of reasons. The present technology introduces additional elements for shaft stabilization. When a standard arrow shaft is released from a bow, the arrow shaft bends around the bow staff. This is due to the arrow being forced from a standstill to full speed very quickly. This bending back and forth creates drag and decreases arrow speed. The presence of vanes and fletchings, while intended to assist in shaft spinning, also creates drag and decreases arrow speed. While shooting an arrow or an elongate projectile with fletchings or vanes in an environment with cross-winds, accuracy of the projectile is severely hampered. This is not to say that fletchings may not be used in the current invention. Rather, in certain aspects, fletchings are not used.

With specific reference now to the figures, FIGS. 1-6 disclose an elongate projectile 5 in accordance with one aspect of the technology. The elongate projectile 5 comprises a shaft 10 having a tip 20, a butt 30, and a stabilizer 50. In one aspect of the technology, the shaft 10 is made of a carbon fiber. However, it is understood that the shaft 10 may be constructed from aluminum, plastic, or any other material suitable for an elongate projectile. In accordance with one aspect of the technology, the tip 20 comprises a machined brass cylinder tapering in both the forward and rearward directions. The outer diameter of the tip 20 is sized larger than the inner diameter of the bore of a rifle. For example, if the bore of a rifle was 0.500 inches (i.e., 50 caliber), the maximum outer diameter of the tip 20 could be sized at 0.515 inches. In this manner, the tip 20 acts as a stop for insertion of the projectile 5 into the bore of the rifle. The front end 21 of the tip 20 is tapered in order to maximize aerodynamics and reduce drag created from wind resistance. The rear end 22 of the tip 20 is also tapered. The tapering of the rear end 22 of the tip 20 functions to help center the tip 20 within the bore as the shaft 10 rests in the bore. In another aspect of the technology, the rear end 22 of the tip 20 is not tapered. Rather, it comprises a substantially flat face and an annular protrusion (or a plurality of at least three individual protrusions) that is collinear with the center of the bore and is intended to seat within the bore of the rifle and center the projectile 5 within the bore of the rifle. The inner diameter of the tip 20 is substantially similar to the outer diameter of the shaft 10 and is secured to the distal end of the shaft 10. In one aspect of the invention, the inner diameter of the tip 20 is substantially similar to the outer diameter of the shaft 10 near a rear opening 23 of the tip 20. The front opening 24 of the tip 20 has a diameter smaller than the shaft 10 to provide for a "seat" for the distal end of the shaft 10. In yet another aspect, the tip 20 comprises a plurality of three blades or points disposed about the exterior of the front end 21 of the tip 20. The front end 21 may be sized to fit within the bore of the rifle with the three blades or points acting to center the shaft 10 within the bore.

In one aspect of the technology, the tip 20 is removably secured to the shaft 10 so that a variety of different tips may be used on the same shaft 10. For example, the tip 20 may be replaced with a broad-head tip for hunting purposes, flat faced tips for target practice, or other tips used for other purposes. The tip 20 may be threaded onto the shaft 10, press-fit, or permanently secured by glue or some other method known in the art. In one aspect of the technology, the tip 20 is made of a dense, heavy material such as brass. The tip 20 is designed to be heavier than the remainder of the shaft 10, the stabilizer 50, and the butt 30. In this manner, the center of gravity of the elongate projectile 5 is balanced forward of the center 11 of the elongate projectile 5 which results in increased stabilization of the projectile 5 during travel through the air. While reference is made to a machined tip, it is understood that the tip 20 may be cast, molded or manufactured in a number of methods known in the art.

In one aspect of the technology, the butt 30 comprises a rigid cylinder having an annular groove (or channel) 31 disposed near the front end of the cylinder and circumscribing the cylinder. The semi-rigid cylinder has an outer diameter that is sized slightly smaller than the inner diameter of the bore of a rifle. In one aspect, the rear end of the butt 30 is tapered to assist in the placement of the projectile 5 into the bore of the rifle. The annular groove 31 is sized to receive one or more resilient O-rings 60 therein with the O-rings 60 circumscribing the annular groove 31. When placed within the annular groove 31, the outer diameter of the O-ring 60 is sized slightly larger than the inner diameter of the rifle bore. In this manner, the O-ring 60 acts to seal the rifle bore to enable pressurized air from an air rifle to deliver a propulsive force to the elongate projectile 5. The O-ring 60 also engages the riflings within the bore. As the elongate projectile 5 is propelled down the bore of the rifle, the riflings cause the elongate projectile 5 to rotate within the shaft 10. The spinning or rotation of the elongate projectile 5 within the bore increases the stabilization of the elongate projectile 5 while in flight. The lack of fletchings or vanes that are traditionally used to achieve spinning, results in a more stable flight path in any type of cross-wind. In other words, the flight path of arrows or elongate projectiles that have traditionally relied on fletchings or vanes to spin while in flight are negatively affected by a cross wind catching on the fletchings or vanes. The present technology eliminates that concern allowing the projectile 5 to fly straighter and longer distances.

Figure 5A:
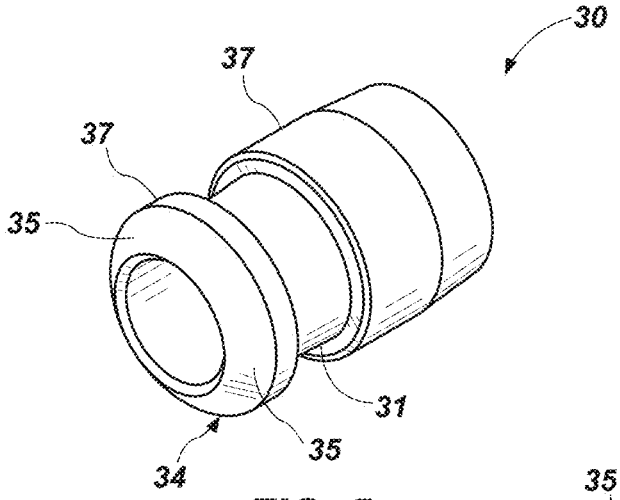
FIG. 5*a* is a perspective view of a butt in accordance with one aspect of the technology.
Figure 5B:
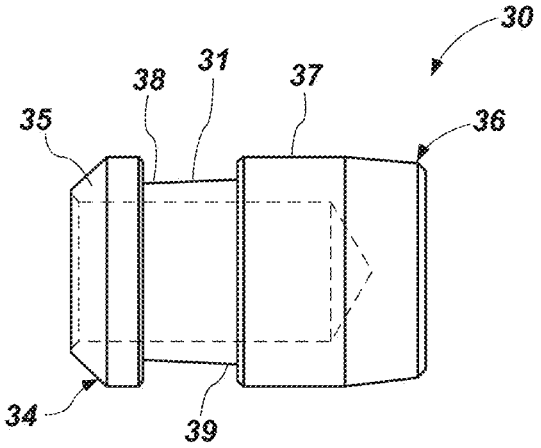
FIG. 5*b* is a cross-sectional side view of the butt shown in FIG. 5*a;*
Figure 5C:
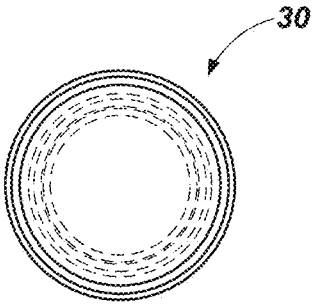
FIG. 5*c* is a top view of the butt shown in FIG. 5*a;*
Figure 6:
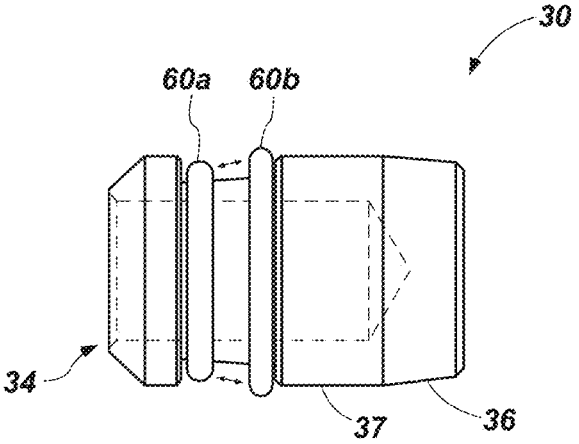
FIG. 6 is a perspective view of a butt with an O-ring in accordance with one aspect of the technology.

With reference to FIGS. 5*a* through 6, in accordance with one aspect of the technology, the annular groove 31 is tapered such that a front end 38 of the annular groove 31 has a smaller diameter than a back end 39 of the annular groove 31. An O-ring 60 (or other shaped sealing member) is placed in the groove 31 and is sized to fit around the smaller diameter of the front end 38 of the annular groove 31. As the elongate projectile 5 is inserted into the bore of the rifle, the O-ring 60*a* rides on the front end 38 of the annular groove 31, the inside of the bore creating friction so that the O-ring 60*a* resists placement into the bore. When a force is provided on the rear end of the butt 30 to propel the elongate projectile 5 out of the rifle, the O-ring 60*b* resists movement based on frictional engagement with the inside of the bore of the rifle. As the elongate projectile 5 is propelled forward, the O-ring 60*b* rides on the back end 39 of the annular groove 31. Because the back end 39 of the annular groove 31 has a diameter that is larger than the front end 38 of the annular groove 31, the O-ring is stretched to match the diameter of the annular groove 31. In this manner, the outer diameter of the O-ring increases and creates increased frictional engagement with the inside of the bore. Advantageously, the increased frictional engagement increases the seal with the inside of the bore improving the efficiency of the air propulsion and improving the engagement with the riflings on the inside of the bore.

In accordance with one aspect of the technology, the O-ring is made of a resilient material such as rubber, nitrile, or polymeric materials. The butt 30 is made from an acetal resin such as Delrin® though it may be made from any suitable material, including, but without limitation, polymers, plastics, alloys and the like. The butt 30 may be molded, extruded, machined, or formed by any suitable method known in the art. The annular groove 31 is placed in the forward half of the cylindrical butt 30. The side surfaces 37 of the butt 30 act as a bearing surface to facilitate travel down the bore of the rifle as the elongate projectile 5.

In accordance with one aspect of the technology, the front face 34 of the butt 30 is substantially perpendicular to a longitudinal axis of the elongate projectile shaft 10. Drag (sometimes called air resistance or air friction) refers to the force acting opposite to the relative motion of any object moving with respect to a surrounding fluid. This can exist between two fluid layers (or surfaces) or a fluid and a solid surface. In the instant application, the interaction between the air and the elongate projectile 5 as the elongate projectile 5 moves in its flight path and the front face 34 of the butt 30 creates drag or frictional forces that act about the outer edge of the front face 34 of the butt 30. While the drag has the negative effect of reducing the speed of the elongate projectile 5, the frictional forces are distributed evenly about the outer edge of the front face 34 and act to stabilize the flight path of the elongate projectile 5.

In accordance with one aspect of the technology, the front face 34 of the butt 30 may be tapered. For example, the front face 34 may be linearly tapered outward at a forty-five degree angle. The tapering of the front face 34 decreases the drag on the butt 30 thereby increasing the speed of the elongate projectile 5, but decreasing the stabilization of the elongate projectile 5 while in flight. While a forty-five degree angle is specifically referenced, the angle of the taper may vary as suits a particular application, particularly with respect to the balancing between increased stability versus increased drag. For example, the front face 34 may vary from ninety degrees (not tapered) to twenty-five degrees (significantly tapered) with a preferred tapering of forty-five degrees. In another aspect, the front face 34 may taper outwardly in a non-linear fashion forming a curved outer surface. The front face 34 may also be linearly tapered inward (or non-linearly, i.e., concave) to increase the amount of drag on the elongate projectile 5 while in flight. The increase in drag increases the stability of the flight path of the elongate projectile 5 at the expense of reduced speed of the projectile 5. The rear end of the butt 30 has a slight taper to facilitate placement of the butt 30 within the bore of a rifle. The inner diameter of the butt 30 is sized to receive an end of the shaft 10 therein. The butt 30 is secured to the shaft permanently (e.g., glued, fused, etc.) or can be removably secured to replace the butt 30 if it becomes worn over time or if the user wishes to use the elongate projectile 5 in a different application (e.g., as a nocked arrow). In accordance with one aspect, the butt 30 is formed from the same material as the shaft 10 and is integrally formed with the shaft 10 rather than being separately manufactured and later coupled to the shaft 10.

A stabilizer 50 is disposed along the shaft 10 of the elongate projectile 5. In one aspect of the technology, the stabilizer 50 is cylindrically shaped with an annular groove 51 disposed therein. The annular groove 51 functions similar to the groove 31 located within the butt 30. That is, it houses an O-ring intended to engage with the riflings of the bore of a rifle. The engagement of the O-rings with the riflings causes the shaft 10 to rotate or spin within the bore. The resulting spinning action increases the elongate projectile 5 stability during flight. Side surfaces 52 of the stabilizer 50 act as bearing surfaces to facilitate travel of the shaft 10 down the bore of the rifle and create the ultimate flight path of the elongate projectile 5. In one aspect of the technology, the stabilizer 50 is spaced a distance of at least five times the diameter of the bore from the butt 30. In other words, if the bore of a rifle intended to propel the elongate projectile 5 has an inner diameter of 0.50 inches, the distance between the front face 34 of the butt 30 and the rear face 53 of the stabilizer 50 is 2.5 inches. The stabilizer 50 may be placed a distance beyond five times the diameter of the bore away from the butt 30 depending on the size of the bore and the relative weight of the elongate projectile 5. For elongate projectiles 5 that are relatively heavy, with a tip 20 that is light (based on a desired use of the tip 20) the stabilizer 50 may be placed nearer the center 11 of the shaft 10 in an effort to balance the elongate projectile 5 to maximize projectile stability. In one aspect of the technology, the annular groove 51 is disposed in the front half of the stabilizer 50. However, in other aspects, the annular groove 51 is disposed in the middle of the stabilizer 50 or towards the rear end of the stabilizer 50.

As with the butt 30, the front face 54 of the stabilizer 50 is substantially perpendicular to a longitudinal axis of the shaft 10 of elongate projectile 5. Similar to the drag created on the front face 34 of the butt 30, as the elongate projectile 5 travels through the air, frictional forces from the air act equally about the outer edge 55 of the front face 54 creating a stabilizing force on the elongate projectile 5 in flight. In one aspect of the technology, the front face 54 may be tapered outward to reduce the drag about the front face 54. In another aspect, the front face 54 may be tapered inward or concave to increase the drag on the front face 54.

While specific reference is made herein to a cylindrical front face 54, it is understood that the front face 54 of the stabilizer 50 (as well as the front face 34 of the butt 30) may have designs placed thereon to optimize the ratio between drag and projectile speed. For example, the front face 54, may not be perfectly planar. Rather, it may have protrusions, indentations, or other designs associated therewith. In addition, other modifications may be made to optimize projectile spin as suits a particular application. For example, one or both of the tip 20 and the stabilizer 50 may be equipped with grooves disposed at an angle to the longitudinal axis of the elongate projectile 5 to induce spinning when the elongate projectile 5 is launched from a smooth bore barrel, crossbow, or other apparatus that lacks riflings. In certain aspects of the technology, the butt 30 is configured to act as the stabilizer 50. This may be in addition to a stabilizer 50 disposed elsewhere about the shaft 10, and may include fletchings that act as conventional stabilizers. It may also include aspects without any additional stabilization means.

Figure 7:
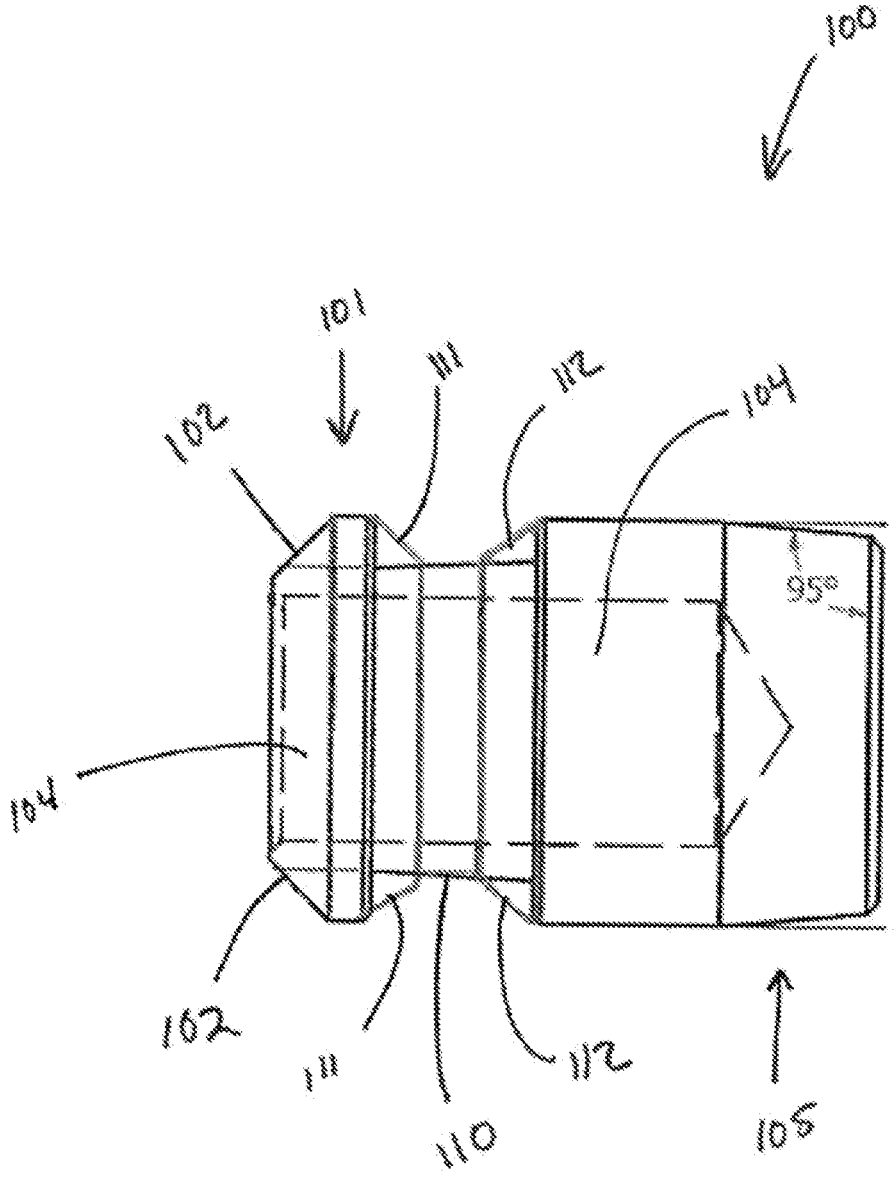
FIG. 7 is a cross-sectional side view of a butt or slug in accordance with one aspect of the technology.

With reference now generally to FIGS. 1-6 and specifically to FIG. 7, a butt 100 is shown having a beveled front face 102 on a proximal end 101. An internal bore 104 is sized to receive the shaft of an arrow therein. The butt 100 comprises a closed distal end 105 forming an enclosure about the internal bore 104. An annular groove or channel 110 is disposed between the distal 105 and proximal 101 ends of the butt 100. Much like the butt of FIGS. 5*a* and 5*b*, for example, or the stabilizer shown in 4*a* and 4*b*, the butt 100 of FIG. 7 does not have an O-ring disposed in the annular groove 110 and may be used without an O-ring both as a stand-alone projectile or in connection with an arrow. In the instance where the butt 100 is used as a slug or bullet in an air gun, there is no internal bore 104. Rather, the butt 100 is substantially solid. Advantageously, when used as a slug in an air gun, the butt 100 engages the riflings in the bore of the air gun compelling the slug to have a spinning action.

In accordance with one aspect of the technology, the annular groove 110 comprises a tapered front section 111 and a tapered rear section 112. While a tapered front section 111 and rear section 112 are both shown, it is understood that the butt 110 could comprise a tapered front section 111 or a tapered rear section 112 or both as suits a particular purpose. In accordance with one aspect where an O-ring (or other resilient member) is disposed within the annular groove 110, when the projectile (either in connection with an arrow or as a stand-alone slug) is propagated from an air-rifle, the air pressure from the air-rifle used to propel the projectile out of the air gun drives the O-ring forward over the tapered front section 111. Because the tapered front section 111 has an increasing outer diameter, as the O-ring is driven forward over the tapered front section 111, the O-ring expands. As the O-ring expands its outer diameter is increased and it engages the side walls of the internal bore of the air rifle. As the O-ring engages the internal bore of the air rifle, frictional forces created by the engagement drive the O-ring towards a rear section of the annular groove 110. It is believed that the pressure gradient from the pressurized air acting on the O-ring decreases as the projectile travels down the bore of the air rifle. Accordingly, it is believed that during its initial movement down the bore of the air rifle, the O-ring is driven forward and, due to its expansion over the front tapered section 111, engages the internal bore of the air gun. However, as the pressure gradient decreases during the initial movement down the bore, the frictional forces acting on the O-ring, driving the O-ring backward will be greater than the air pressure driving O-ring forward. As that happens, the O-ring will be driven backward and return to its biased (or non-expanded) state within the non-tapered portion of the annular groove 110. In one aspect, a frictional force continues to act on the O-ring as the projectile travels down the bore of the air rifle causing the O-ring to continue to move backward and over the rear tapered section 112. While in its biased state, the O-ring engages the sidewall of the internal bore, however, in one aspect, the engagement is not enough to create satisfactory "spinning" of the projectile. As the O-ring is propelled or driven backward over the rear tapered section 112, it expands and engages the internal bore to a greater degree creating a greater seal or greater engagement resulting in increased "spinning" of the projectile. It is believed that the degree to which the O-ring is advanced over the front tapered section 111 and its movement rearward as the projectile travels down the bore of the air gun is a function primarily of the sizing of the O-ring with respect to the internal bore of the air gun and the diameter of the annular groove 110, and the amount of pressure acting on the projectile from pressurized air. The system seeks equilibrium between the air pressure driving the O-ring forward, the frictional forces resulting from engagement of the O-ring with the internal bore of the air gun, and the O-ring's tendency to return to its biased state in the non-tapered section of the annular groove 110. Advantageously, the present technology takes advantage of all three forces to optimize engagement of the O-ring with the riflings of the bore of the air gun.

While reference is made to a single O-ring on butt 100, it is understood that one or more O-rings (or other resilient members) may be disposed in a single annular groove 110. In one aspect, it is believed that as a first O-ring is driven backward over the rear tapered section 112, a second O-ring, abutted against the first O-ring, is also driven backward pushing the first O-ring further over the rear tapered section 112 resulting in an increased engagement against the internal bore of the air gun. The foregoing examples include use of the butt 100 on an arrow as shown in FIG. 1, for example, or as a stand-alone slug shot from an air gun as a bullet. Moreover, while the front and rear tapered sections 111, 112 are shown as having opposing 45 degree slopes, it is understood that any angle less than 90 degrees (i.e., perpendicular to longitudinal axis of butt 100) and greater than 0 degrees (i.e., parallel to longitudinal axis of butt 100) may be used as suits a particular design. Moreover, while the front and rear tapered sections 111, 112 are shown as having substantially equal slopes when comparing the absolute value of the slopes, it is understood that the front and rear tapered sections 111, 112, may have different slopes as suits a particular design need. For example, the slope of the front tapered section 111 may be greater than the slope of the rear tapered section 112 or vice versa. In addition, the lengths of the front and rear tapered sections 111, 112 may be substantially equivalent or one may be longer than the other as suits a particular design need.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A system for propelling an elongate projectile from an air gun having a rifled bore, comprising:

a cylinder disposed about the back end of the elongate projectile, said cylinder having a front side and a back side and substantially parallel sidewalls, said cylinder further comprising an annular groove circumscribing the cylinder between the front and back sides, wherein the elongate projectile is configured to be placed back-side-first into the air gun;

a front tapered section disposed about a front of the annular groove, a non-tapered section disposed rearward of the front tapered section, and a tapered rearward section disposed rearward of the non-tapered section;

a resilient annular member disposed within the annular groove, said resilient annular member having a first position in a biased state within the annular groove, and a second position in a non-biased state rearward of the annular groove;

wherein when the resilient member is in the non-biased state and the elongate projectile is propelled outward through the rifled bore of the air gun, frictional engagement between the resilient member and the rifled bore causes the elongate projectile to rotate.

2. The projectile of claim 1, further comprising a rear tapered section disposed about the rear of the annular groove, wherein the resilient annular member further comprises a third position in a non-biased state about the rear tapered section.

3. The projectile of claim 1, wherein the projectile further comprises an elongate member coupled to a front side of the cylinder, the elongate member having an outer diameter that is less than an outer diameter of the cylinder.

4. The projectile of claim 1, further comprising a tip having an outside diameter greater than the outside diameter of the elongate member.

5. The projectile of claim 4, wherein the tip comprises an outside diameter that is greater than an inside diameter of the air gun and extends outside of the bore of the air gun.

6. The projectile of claim 1, wherein a front face of the cylinder is tapered downward toward the front end of the elongate projectile.

7. The projectile of claim 1, wherein an outer diameter resilient member in the non-biased state comprises the maximum diameter of the elongate projectile.

8. The projectile of claim 1, further comprising a second cylinder disposed about the elongate projectile distally from the first cylinder.

9. A system for propelling an elongate from an air gun having a rifled bore, comprising:

a cylinder disposed about the back end of the elongate projectile, said cylinder having a front side and a back side, said cylinder further comprising an annular groove circumscribing the cylinder between the front and back sides, wherein the elongate projectile is configured to be placed back-side-first into the air gun;

a front tapered section disposed about a front of the annular groove, a non-tapered section disposed rearward of the front tapered section, and a rear-tapered section disposed rearward of the non-tapered section, wherein the non-tapered section and rear tapered section comprise at least half of the longitudinal length of the cylinder;

a resilient annular member disposed within the annular groove, said resilient annular member having a first position in a biased state within the non-tapered section of the annular groove, a second position in a non-biased state about the front tapered section;

wherein when the resilient member is in the non-biased state and the elongate projectile is propelled outward through the rifled bore of the air gun, frictional engagement between the resilient member and the rifled bore causes the elongate projectile to rotate.

* * * * *